US012529233B2

(12) United States Patent
Yang

(10) Patent No.: US 12,529,233 B2
(45) Date of Patent: Jan. 20, 2026

(54) STEEL-STRUCTURE BUILDING ENVELOPE CAPABLE OF ERECTING SCAFFOLD AND METHOD FOR ERECTING SCAFFOLD

(71) Applicant: Feng-Yi Yang, Kaohsiung (TW)

(72) Inventor: Feng-Yi Yang, Kaohsiung (TW)

( * ) Notice: Subject to any disclaimer, the term of this patent is extended or adjusted under 35 U.S.C. 154(b) by 323 days.

(21) Appl. No.: 18/462,725

(22) Filed: Sep. 7, 2023

(65) Prior Publication Data

US 2025/0084651 A1 Mar. 13, 2025

(51) Int. Cl.
*E04G 5/04* (2006.01)
*E04G 1/38* (2006.01)

(52) U.S. Cl.
CPC ..... *E04G 5/04* (2013.01); *E04G 1/38* (2013.01); *E04G 5/046* (2013.01)

(58) Field of Classification Search
CPC ..... E04G 5/04; E04G 1/38; E04G 5/046
USPC ..... 52/173.1, 651.1
See application file for complete search history.

(56) References Cited

U.S. PATENT DOCUMENTS 5,878,840 A * 3/1999 Tessum ..... E04G 5/04 182/229
9,016,025 B2 * 4/2015 Jin ..... E04G 11/28 52/651.1
12,227,942 B2 * 2/2025 Yang ..... E04B 2/84
2015/0075910 A1 * 3/2015 Thacker ..... E04G 3/305 182/229

FOREIGN PATENT DOCUMENTS

| | | | | |
|---|---|---|---|---|
| CN | 118065610 A * | 5/2024 | ..... | E04G 5/007 |
| DE | 102008061544 A1 | 6/2010 | | |
| IT | RM970602 | 10/1997 | | |
| KR | 200494186 Y1 * | 8/2021 | ..... | E04G 5/04 |
| TW | M640233 U | 4/2023 | | |

* cited by examiner

*Primary Examiner* — Patrick J Maestri
(74) *Attorney, Agent, or Firm* — Rosenberg, Klein & Lee

(57) ABSTRACT

A steel-structure building envelope capable of erecting a scaffold and a method for erecting the scaffold are disclosed. The scaffold is fastened to the steel-structure building envelope through two steps fastening means. A pre-embedded reinforcing steel bar is laid in each of RC slabs and extends out of the corresponding RC slab to be wound around the scaffold, serving as the first fastening means for fastening the scaffold. Locking parts are embedded into the corresponding RC slab at intervals. The transverse aluminum extrusion is disposed on an outside of the corresponding RC slab. The wall connecting rods each have a first end that passes through the transverse aluminum extrusion and is locked to the corresponding locking part and a second end configured to lock the scaffold, serving as a second fastening means for fastening the scaffold after the pre-embedded reinforcing steel bar is removed from the scaffold.

10 Claims, 6 Drawing Sheets

STEEL-STRUCTURE BUILDING ENVELOPE CAPABLE OF ERECTING SCAFFOLD AND METHOD FOR ERECTING SCAFFOLD

BACKGROUND OF THE INVENTION

1. Technical Field

The present invention relates to a steel-structure building envelope capable of erecting a scaffold and a method for erecting the scaffold, and more particularly to a steel-structure building envelope provided with a transverse aluminum extrusion. The scaffold is fastened to the transverse aluminum extrusion through a first fastening means and a second fastening means, so that external walls can be assembled to the scaffold, without using high-altitude hoist operations.

2. Description of Related Art

Ancient residential buildings in Taiwan were mostly constructed using bricks, and modern residential buildings started to be popular after ferroconcrete constructing technologies were introduced and commoditized in Taiwan. In recent years, with the increase of economic development, population density, and in turn land costs, more and more steel-construction skyscrapers have been built for not only business use but also residential use. According to statistics, residential buildings form a staple part, taking up more than ninety percent, of all buildings in Taiwan.

In general, there are three structural types of modern buildings in Taiwan, i.e., RC (reinforced concrete), SS (steel structure), and SRC (steel reinforced concrete). Compared with the traditional RC structure (reinforced concrete), SS structure (steel structure) or SRC structure (steel reinforced concrete) has the environmental protection characteristics, such as long life and recyclable materials. However, the construction cost of SS structure (steel structure) or SRC structure (steel reinforced concrete) is high, so most of residential buildings use RC structures (reinforced concrete).

In RC structure (reinforced concrete) buildings, by erecting the scaffold, the construction workers can construct the building structure on high floors through the scaffold. The scaffold is erected by pre-embedded reinforcing steel bars (such as corrugated reinforcing steel bars with an imperial bar size of number 3 (#3) on the RC beams of the building body. The distance between adjacent embedded reinforcing steel bars is approximately 160 cm to 180 cm (the distance is adjustable according to the diagram for erecting the scaffold). Then, the scaffold is fixed on the outside of the building body by winding the embedded reinforcing steel bars around the scaffold. The position error is allowed when the scaffold is erected by the pre-embedded reinforcing steel bars, which will not affect the subsequent construction. Thus, the erection of the scaffold can be completed quickly.

In steel-structure buildings, such as SS structure (steel structure) or SRC structure (steel reinforced concrete), external walls are typically curtain walls. Curtain walls have light own weights, and are made modular so as to be easily assembled. The curtain walls are hung outside the floor slabs by joining components.

However, the embedded reinforcing steel bars used for fastening the scaffold of the building structure will form an obstacle to the assembly of the curtain walls. Thus curtain walls cannot be assembled by erecting the scaffold. In general, the curtain walls are assembled using high-altitude hoist operations. However, the high costs of hoists and specialized persons required for high-altitude hoist operations further increase the cost of steel-structure buildings, which is not conducive to the promotion of steel-structure buildings.

SUMMARY OF THE INVENTION

Taiwan Patent Application No. 111147640, titled "STEEL-STRUCTURE BUILDING ENVELOPE", filed by the invention, is mainly aimed at reducing the construction cost of steel-structure residential buildings. In order to further facilitate erection of scaffolds on steel-structure buildings and assembly of external walls (such as curtain walls) on the scaffold, the present invention provides a steel-structure building envelope capable of erecting a scaffold, comprising a building body, floor slabs, and external walls.

The building body has H beams and decks. The decks are assembled onto the H beams.

The floor slabs have RC slabs laid on the decks, so that the decks and the RC slabs jointly act as the floor slabs. A reinforcing bar structure and a pre-embedded reinforcing steel bar are laid in each of the RC slabs. The pre-embedded reinforcing steel bar extends out of the corresponding RC slab to be wound around the scaffold, serving as a first fastening means for fastening the scaffold.

The external walls each include wall connecting rods, locking parts used for locking the wall connecting rods, a transverse aluminum extrusion, and outer wall panels. The locking parts are embedded into the corresponding RC slab at intervals. The transverse aluminum extrusion is disposed on an outside of the corresponding RC slab. The wall connecting rods each have a first end that passes through the transverse aluminum extrusion and is locked to the corresponding locking part and a second end configured to lock the scaffold, serving as a second fastening means for fastening the scaffold after the pre-embedded reinforcing steel bar is removed from the scaffold. The outer wall panels are each installed between the adjacent floor slabs laterally. The adjacent outer wall panels are separated by the transverse aluminum extrusion.

When the external walls are completed, the wall connecting rods are disassembled one by one so as to remove the scaffold.

The present invention further provides a method for erecting a scaffold of a steel-structure building envelope, comprising the following steps:

- constructing a building body: assembling H beams and decks of the building body, the decks being assembled onto the H beams;
- constructing floor slabs: laying RC slabs on the decks, the decks and the RC slabs jointly acting as the floor slabs, laying a reinforcing bar structure and a pre-embedded reinforcing steel bar in each of the RC slabs, the pre-embedded reinforcing steel bar extending out of the corresponding RC slab to be wound around the scaffold, serving as a first fastening means for fastening the scaffold;
- constructing external walls: embedding locking parts used for locking wall connecting rods into the corresponding RC slab at intervals, providing a transverse aluminum extrusion on an outside of the corresponding RC slab, wherein the wall connecting rods each have a first end that passes through the transverse aluminum extrusion and is locked to the corresponding locking part and a second end configured to lock the scaffold, serving as a second fastening means for fastening the scaffold after the pre-embedded reinforcing steel bar is removed from the scaffold; installing outer wall panels each between the adjacent floor slabs laterally, wherein the adjacent outer wall panels are separated by the transverse aluminum extrusion.

When the external walls are completed, the wall connecting rods are disassembled one by one so as to remove the scaffold.

Further, the pre-embedded reinforcing steel bar is a corrugated reinforcing steel bar with an imperial bar size of number 3 (#3), and the corrugated reinforcing steel bar is wound around the scaffold at least three and a half times.

Further, after the pre-embedded reinforcing steel bar is removed from the scaffold, part of the pre-embedded reinforcing steel bar, exposed on the corresponding RC slab, is cut off.

Further, the locking part is an expansion screw, and the first end of the corresponding wall connecting rod is locked to the expansion screw with a bolt.

Further, after the wall connecting rods are disassembled, the locking parts are locked with nuts, or are stuffed with silicone and then sealed with paint.

According to the above technical features, the present invention can achieve the following effects:

1. The scaffold is fastened to the transverse aluminum extrusion through the first fastening means and the second fastening means, so that the curtain wall can be assembled on the scaffold without using high-altitude hoist operations, which can reduce the cost of steel-structure buildings, facilitate promotion of steel-structure buildings, prolong the service life of buildings and meet the requirements of environmental protection.

2. In the present invention, the first fastening means for fastening the scaffold uses the pre-embedded reinforcing steel bar to wind around the scaffold, which can quickly complete erection of the scaffold; the second fastening means for fastening the scaffold uses the wall connecting rods instead of the pre-embedded reinforcing steel bar. In addition to assembling the curtain walls on the scaffold, the precise alignment of the wall connecting rods makes the scaffold more stable and improves safety.

DETAILED DESCRIPTION OF THE INVENTION

The embodiments described below are intended to illustrate the disclosed building envelope of the present invention, but not to limit the scope of the present invention. Therein, since the steel-structure building envelope is huge in volume, features are presented in local, close-up views for explicitness.

In an embodiment of the present invention, a steel-structure building envelope comprises a building body A, floor slabs B and external walls C.

Figure 1:
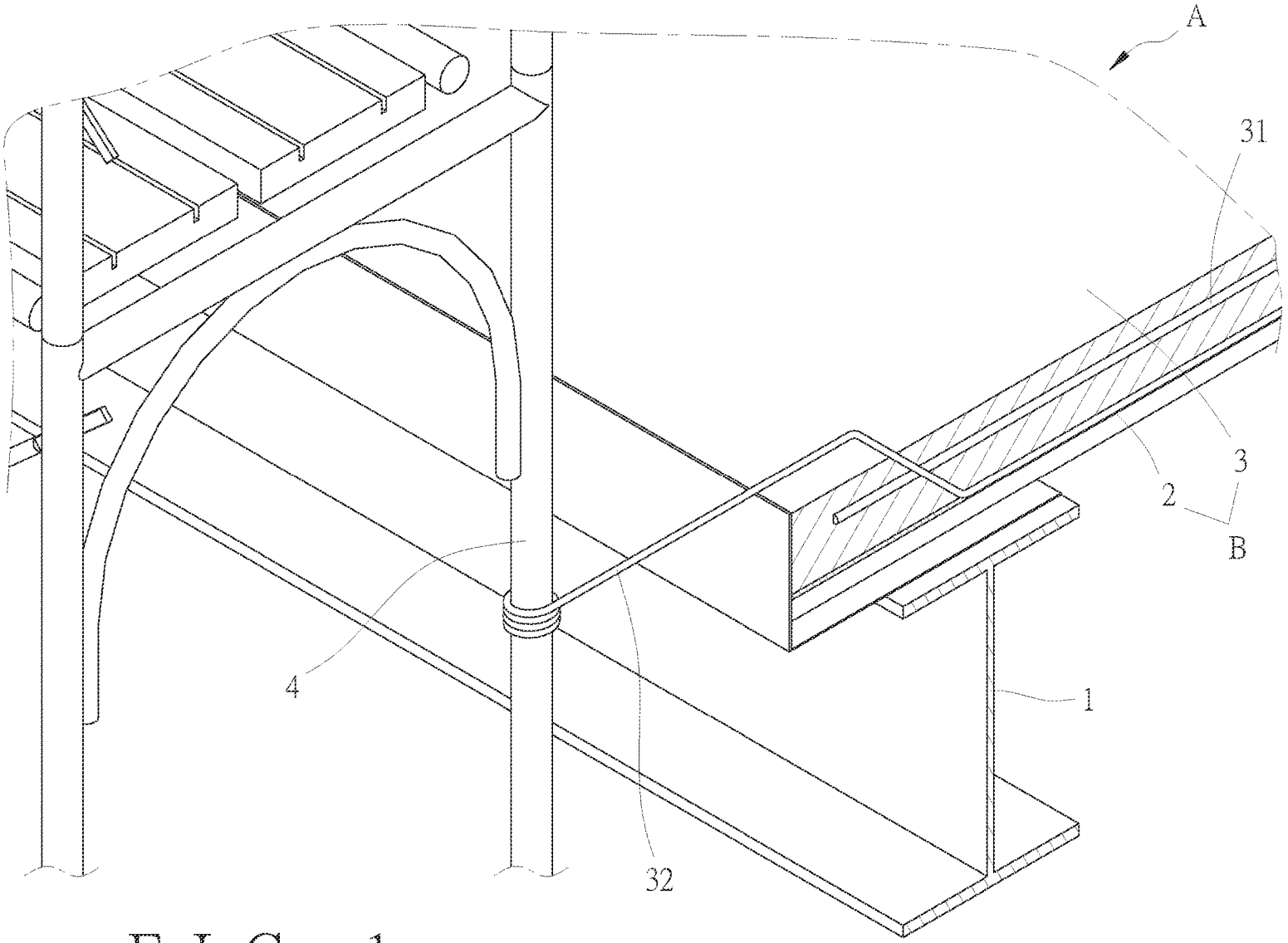
FIG. 1 is a local perspective view of a steel-structure building envelope according to an embodiment of the present invention, wherein a corrugated reinforcing steel bar extends out of an RC slab to be wound around a scaffold, serving as a first fastening means for fastening the scaffold.
Figure 2:
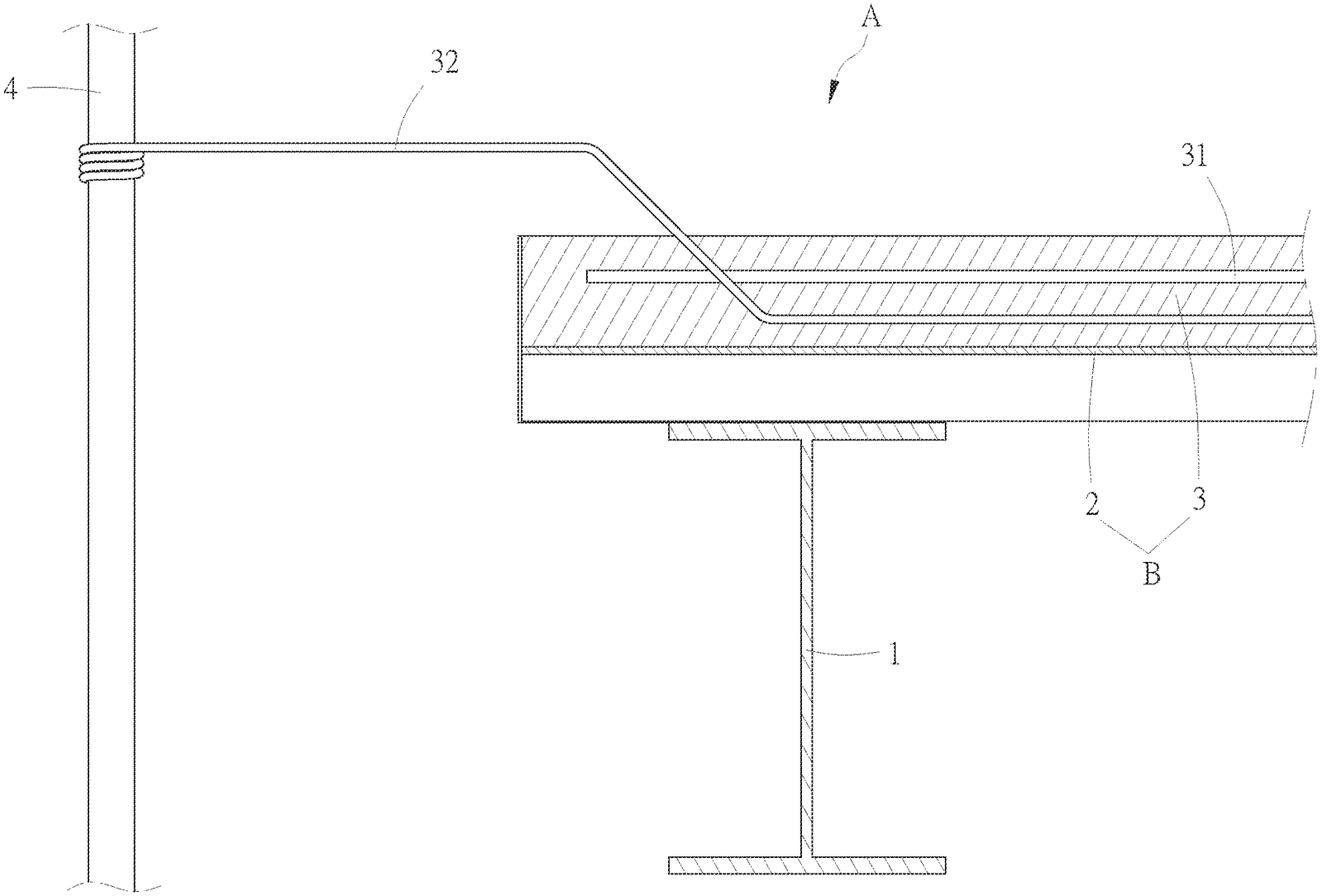
FIG. 2 is a cross-sectional view of FIG. 1.

Referring to FIG. 1 and FIG. 2, the building body A is first constructed. The building body A comprises H beams 1 and decks 2. The decks 2 are assembled onto the H beams 1.

After the building body A is assembled, the floor slabs B are constructed. The floor slabs B comprises RC slabs 3 laid on the decks 2 so that the decks 2 and the RC slabs 3 jointly act as the floor slabs B. A reinforcing bar structure 31 and a pre-embedded reinforcing steel bar are laid in each of the RC slabs 3. In the present embodiment, the pre-embedded reinforcing steel bar is a corrugated reinforcing steel bar 32 with an imperial bar size of number 3 (#3). The corrugated reinforcing steel bar 32 extends out of the corresponding RC slab 3 to be wound around a scaffold 4, serving as a first fastening means for fastening the scaffold 4. In order to ensure that the scaffold 4 is stable and conforms to the required strength of the regulations, the corrugated reinforcing steel bar 32 is wound around the scaffold 4 at least three and a half times. If the pre-embedded reinforcing steel bar is in a different size, such as a corrugated reinforcing steel bar with an imperial bar size of number 4 (#4), it is wound around the scaffold 4 according to the requirements of the regulations.

Figure 3:
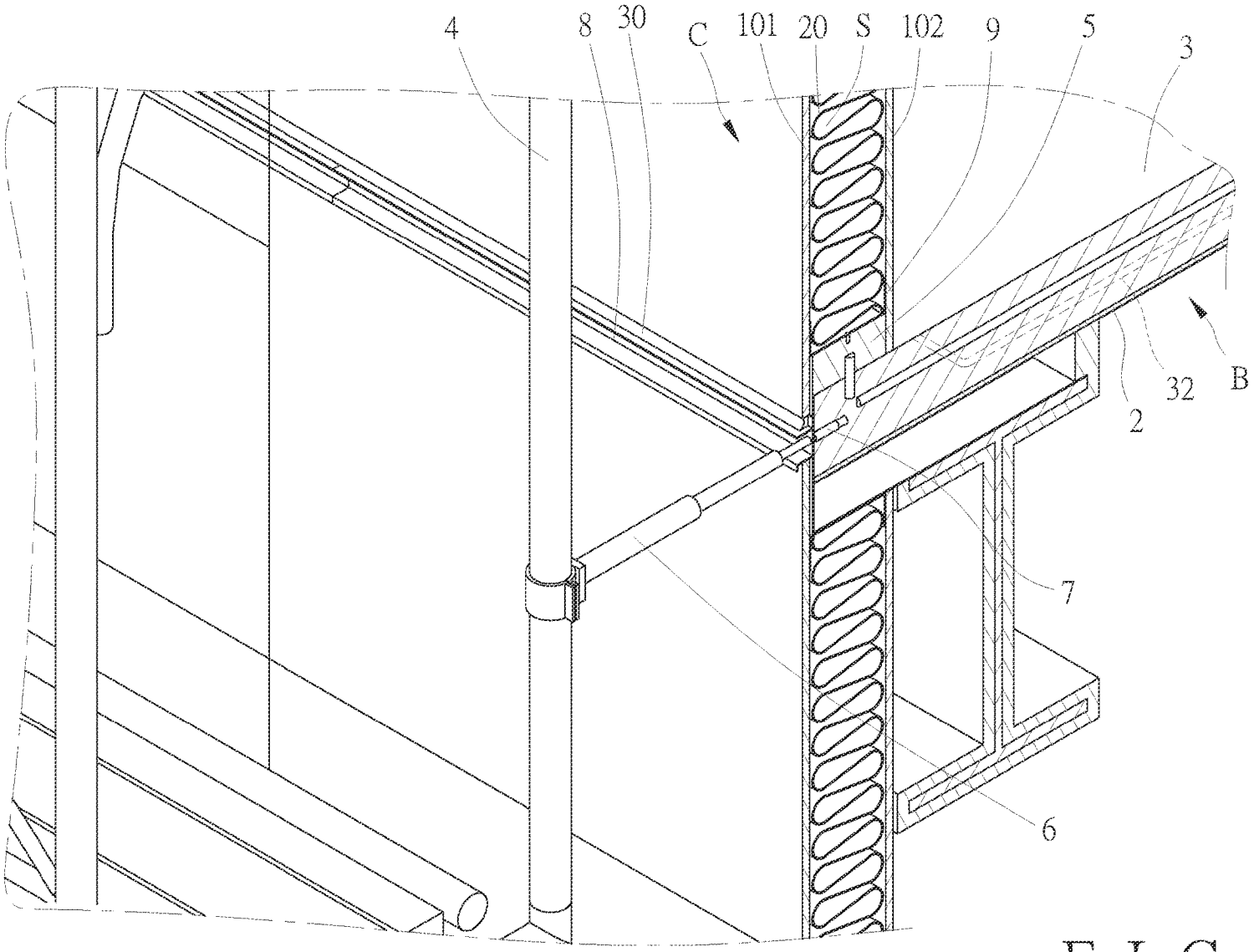
FIG. 3 is a local perspective view of the steel-structure building envelope according to the embodiment of the present invention, wherein a wall connecting rod serves as a second fastening means for fastening the scaffold.
Figure 4:
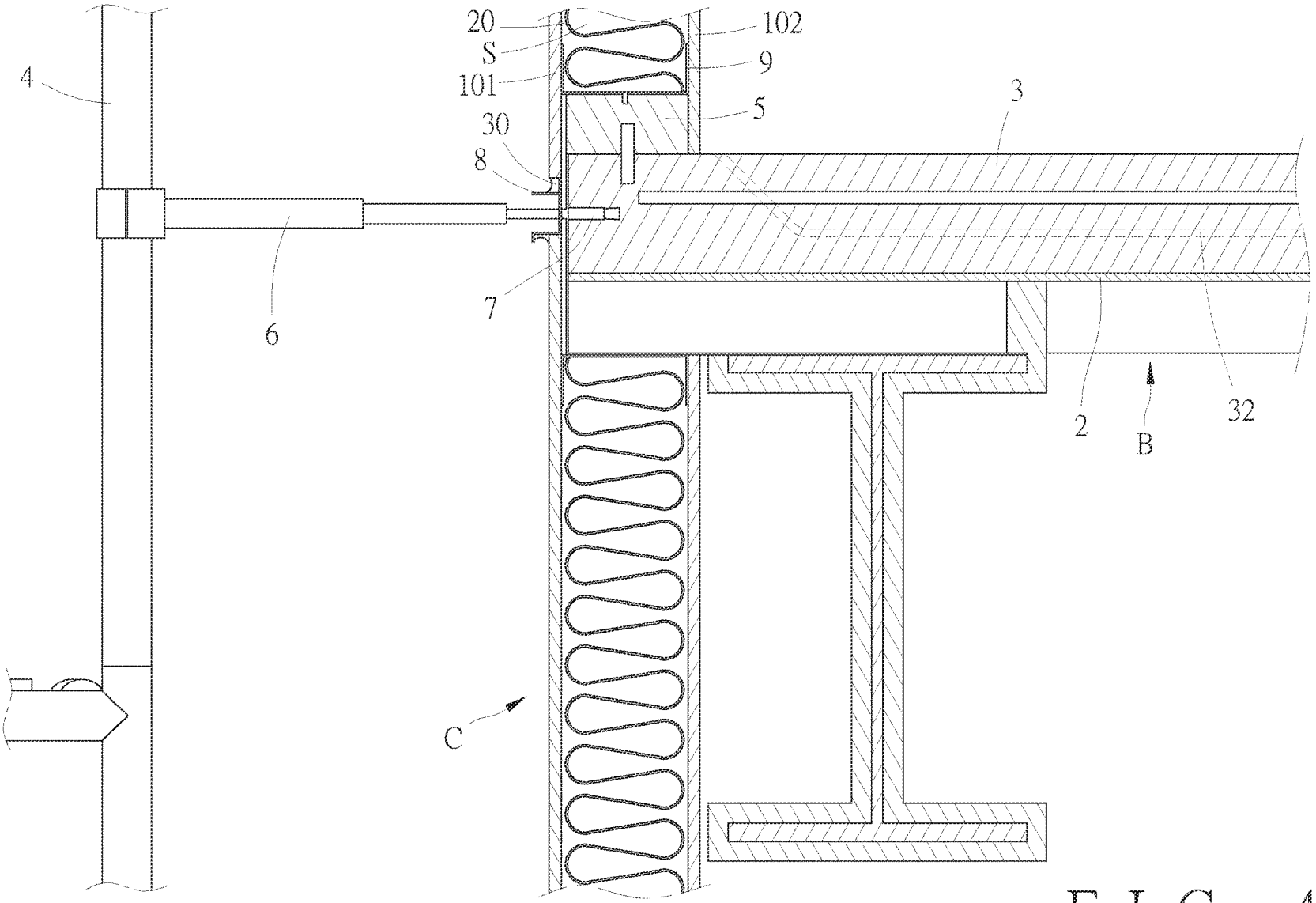
FIG. 4 is a cross-sectional view of FIG. 3.

Referring to FIG. 3 and FIG. 4, after the construction of the floor slabs B is completed and the scaffold 4 is fastened by the first fastening means, the construction of the external walls C can be performed. In the present embodiment, the external walls C have a two-layer structure. An RC curb 5 is formed on the RC slab 3 by means of casting. After that, locking parts 7 for locking wall connecting rods 6 are embedded into the RC slab 3 at intervals. A transverse aluminum extrusion 8 is disposed on the outside of the RC slab 3. The wall connecting rods 6 each have one end passing through the transverse aluminum extrusion 8 and locked to the corresponding locking part 7. In the present embodiment, the locking part 7 is an expansion screw. The wall connecting rod 6 is locked to the locking part 7 with a bolt, and can carry a load of 2 tons after testing. The other end of the wall connecting rod 6 is configured to lock the scaffold 4, serving as a second fastening means for fastening the scaffold 4 after the corrugated reinforcing steel bar 32 is removed from the scaffold 4. After removing the corrugated reinforcing steel bar 32 from the scaffold 4, the part of the corrugated reinforcing steel bar 32, exposed on the RC slab 3, can be cut off.

Next, one steel C profile 9 is installed on the RC curb 5 with an opening thereof facing upward, and another steel C profile 9 is mounted on the deck 2 with an opening thereof facing downward. An outer wall panel 101 and an inner wall panel 102 are attached to opposite sides of the RC curb 5 and the two steel C profiles 9, so that a hollow space S is formed between the outer wall panel 101 and the inner wall panel 102. Thereby, the external wall C has a two-layer structure and is affixed directly to the floor slab B. With the configuration, the floor slab B can completely separate the space of the upper story from the space of the lower story by providing good water cut-off and acoustic/thermal insulation between the upper and lower stories. The outer wall panel 101 is installed between the floor slabs B from the outside, and the adjacent outer wall panels 101 are separated by the transverse aluminum extrusion 8. Additionally, elastic cement may be filled in assembly gaps between the adjacent outer wall panels 101, so as to enhance waterproofing between the indoor side and the outdoor side of the building. In the present embodiment, a sound insulation material 20 is attached to each of the two steel C profiles 9, and partially received in the hollow space S. The sound insulation material 20 extends along the height of the external wall C. For example, the hollow space S is filled with rockwool. Thereby, with the hollow space S and the sound insulation material 20 inlaid in the two-layer structure of the external wall C, acoustic/thermal insulation between the indoor side and the outdoor side of the building is enhanced. Then, silicone 30 is injected between the transverse aluminum extrusion 8 and the two outer wall panels 101. As compared to traditional integrated curtain walls that tend to break due to resonance when receiving force or shocks, the structure of the present invention has the adjacent outer wall panels 101 separated by the transverse aluminum extrusions 8 so as to reduce the risk of force-based breakage of the outer wall panels 101. The external walls C include the transverse aluminum extrusions 8 at inter-story seams as physical caulking, so the use of silicone 30 can be reduced, thereby facilitating maintenance and saving costs.

Figure 5:
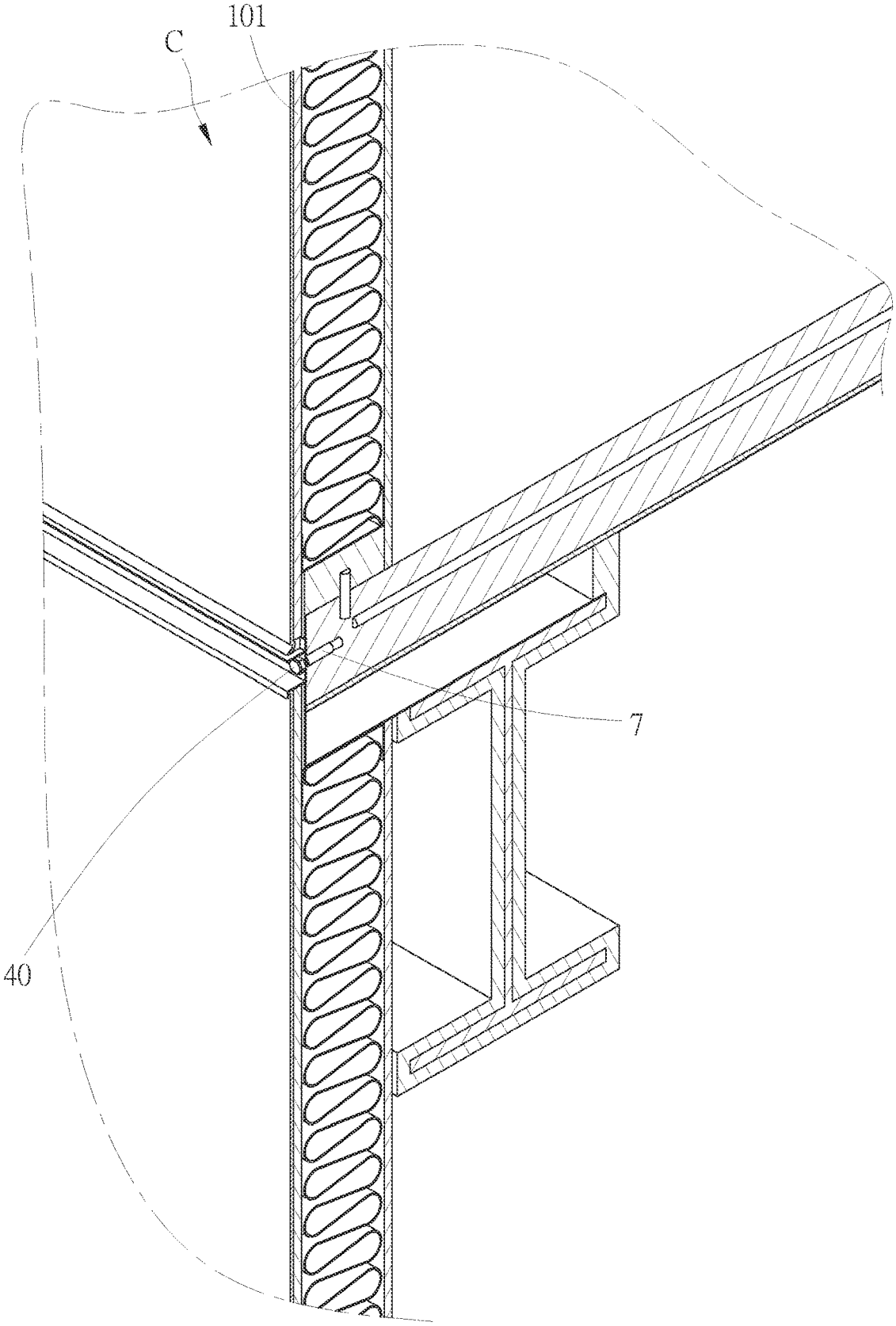
FIG. 5 is a local perspective view of the steel-structure building envelope according to the embodiment of the present invention, wherein the wall connecting rod is removed and a nut is locked to a locking part after outer wall panels are assembled.
Figure 6:
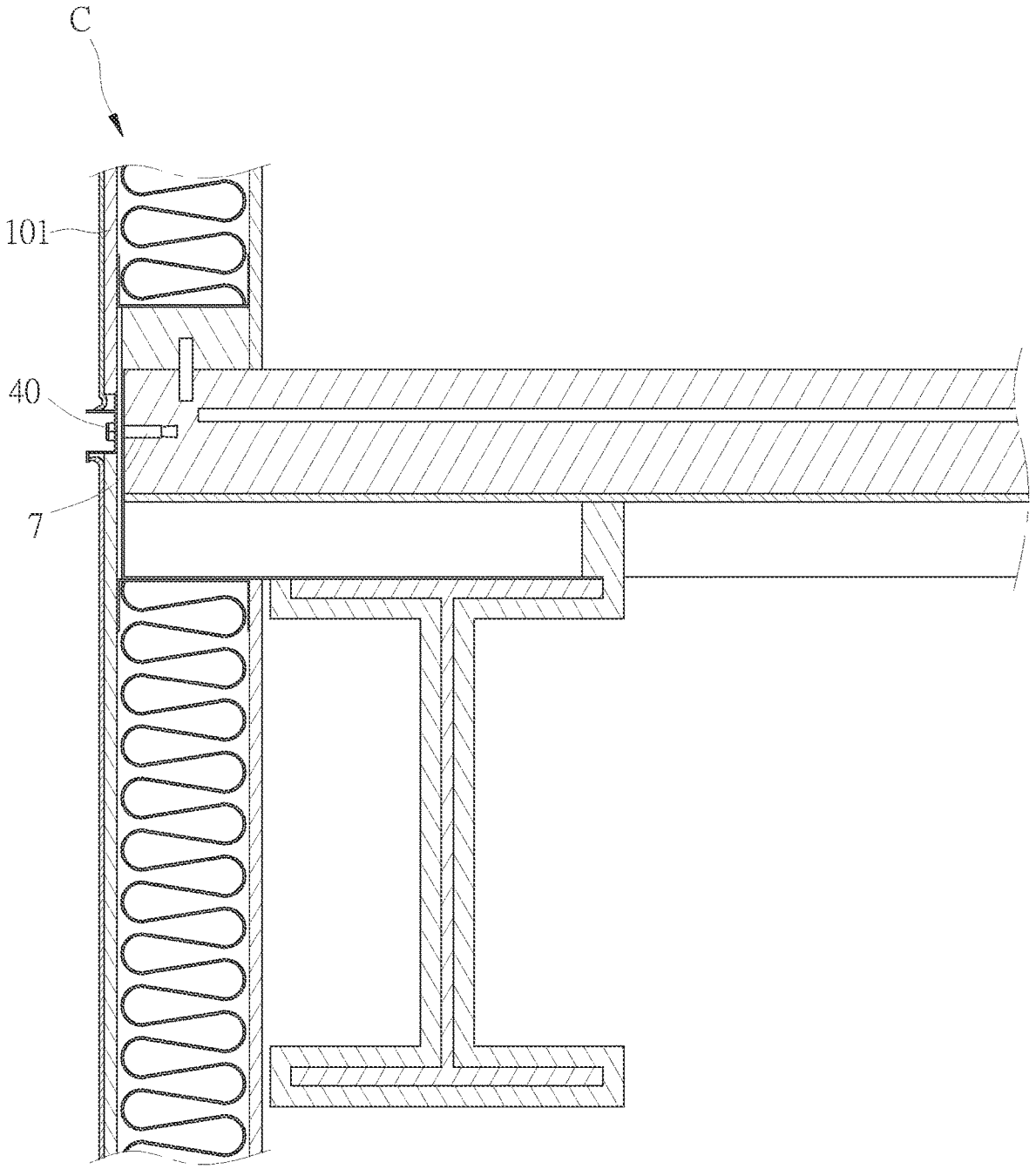
FIG. 6 is a cross-sectional view of FIG. 5.

Referring to FIG. 5 and FIG. 6, when the external walls C are completed, the wall connecting rods 6 are disassembled one by one so as to remove the scaffold 4. (As to the wall connecting rods 6 and the scaffold 4, please refer to FIG. 3 and FIG. 4). After the wall connecting rods 6 are disassembled, the locking parts 7 are locked with nuts 40, or are stuffed with silicone and then sealed with paint. In the present invention, since the assembled outer wall panels 101 are level and flush to each other, instead of further tiling, the external walls C can be easily finished by covering the outer wall panels 101 across the surface of the building with waterproof coating and natural paint successively.

Construction of the present embodiment is implemented as below, with details identical or similar to those known by people skilled in the art of SS construction omitted in the description and left out from the drawings for not blurring characteristics of the present embodiment. The construction includes: (1) assembling steel box columns and H beams 1 for each story; (2) laying decks 2 and pour stops for each story; (3) setting the outlet and piping; (4) laying a reinforcing bar structure 31 (or welded wire fabrics) and embedding a corrugated reinforcing steel bar 32 with an imperial bar size of number 3 (#3) for each story; (5) concreting an RC slab 3 for each story; (6) putting up a scaffold 4 and winding the corrugated reinforcing steel bar 32 around the scaffold 4 at least three and a half times as a first fastening means for fastening the scaffold 4; (7) constructing RC curbs 5 (including rebar-planting and grouting); (8) setting outlet of and installing Z-shaped iron parts; (9) applying fire-resistive coating to the steel box columns and the H beams 1 for each story; (10) setting out locking parts 7 of wall connecting rods 6 in place; (11) installing the locking parts 7 of the wall connecting rods 6 in the RC lab 3; (12) installing a transverse aluminum extrusion 8; (13) locking the scaffold 4 with the wall connecting rods 6 and removing the corrugated reinforcing steel bar 32 one by one as a second fastening means for fastening the scaffold 4; (14) setting out Type 125 steel C profiles (including steel C profiles 9 in the external walls C) with predetermined intervals, performing vertical calibration, and fixing them in position for each story; (15) setting out Type 125 steel C profiles (including fitting transoms and fixing iron parts) at the facade of any opening, door, or window; (16) fastening outer wall panels 101; (17) stuffing assembly gaps between the adjacent outer wall panels 101 with elastic cement (stuffing assembly gaps between the adjacent outer wall panels 101 with tile gripper); (18) closing the assembly gaps between the adjacent outer wall panels 101 with anti-crack nets; (19) arranging sound insulation materials 2 in the external walls C; (20) fastening inner wall panels 102; (21) fastening aluminum window fittings; (22) installing aluminum window frames and doorframes; (23) caulking doors and windows; (24) installing drip lines for doors and windows; (25) constructing fire protection stuffing for all assembly gaps between the building body A, the floor slabs B, and the external walls C; (26) spraying waterproof coating on the outer wall panels 101 across the building; (27) stuffing silicone around the aluminum window frames and doorframes; (28) painting the outer wall panels 101 with natural paint; (29) removing the scaffold 4 of each story, removing the wall connecting rods 6 one by one, locking nut 40 or stuffing silicone to the locking parts 7; and (30) finishing construction of the external walls of the current story.

In the present invention, the scaffold is fastened to the transverse aluminum extrusion through the first fastening means and the second fastening means, so that the curtain wall can be assembled on the scaffold without using high-altitude hoist operations, which can reduce the cost of steel-structure buildings, facilitate the promotion of steel-structure buildings, prolong the service life of buildings and meet the requirements of environmental protection.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A steel-structure building envelope capable of erecting a scaffold, comprising:

a building body, having H beams and decks, the decks being assembled onto the H beams;

floor slabs, having RC slabs laid on the decks, so that the decks and the RC slabs jointly act as the floor slabs; a reinforcing bar structure and a pre-embedded reinforcing steel bar being laid in each of the RC slabs, the pre-embedded reinforcing steel bar extending out of the corresponding RC slab to be wound around the scaffold, serving as a first fastening means for fastening the scaffold;

external walls, each including:

wall connecting rods;

locking parts for locking the wall connecting rods, the locking parts being embedded into the corresponding RC slab at intervals;

a transverse aluminum extrusion, disposed on an outside of the corresponding RC slab;

wherein the wall connecting rods each have a first end that passes through the transverse aluminum extrusion and is locked to the corresponding locking part and a second end configured to lock the scaffold, serving as a second fastening means for fastening the scaffold after the pre-embedded reinforcing steel bar is removed from the scaffold;

outer wall panels, each installed between the adjacent floor slabs laterally, wherein the adjacent outer wall panels are separated by the transverse aluminum extrusion;

wherein when the external walls are completed, the wall connecting rods are disassembled one by one so as to remove the scaffold.

2. The steel-structure building envelope as claimed in claim 1, wherein the pre-embedded reinforcing steel bar is a corrugated reinforcing steel bar with an imperial bar size of number 3 (#3), and the corrugated reinforcing steel bar is wound around the scaffold at least three and a half times.

3. The steel-structure building envelope as claimed in claim 1, wherein after the pre-embedded reinforcing steel bar is removed from the scaffold, part of the pre-embedded reinforcing steel bar, exposed on the corresponding RC slab, is cut off.

4. The steel-structure building envelope as claimed in claim 1, wherein the locking part is an expansion screw, and the first end of the corresponding wall connecting rod is locked to the expansion screw with a bolt.

5. The steel-structure building envelope as claimed in claim 1, wherein after the wall connecting rods are disassembled, the locking parts are locked with nuts, or are stuffed with silicone and then sealed with paint.

6. A method for erecting a scaffold of a steel-structure building envelope, comprising the following steps:

constructing a building body: assembling H beams and decks of the building body, the decks being assembled onto the H beams;

constructing floor slabs: laying RC slabs on the decks, the decks and the RC slabs jointly acting as the floor slabs, laying a reinforcing bar structure and a pre-embedded reinforcing steel bar in each of the RC slabs, the pre-embedded reinforcing steel bar extending out of the corresponding RC slab to be wound around the scaffold, serving as a first fastening means for fastening the scaffold;

constructing external walls: embedding locking parts used for locking wall connecting rods into the corresponding RC slab at intervals, providing a transverse aluminum extrusion on an outside of the corresponding RC slab, wherein the wall connecting rods each have a first end that passes through the transverse aluminum extrusion and is locked to the corresponding locking part and a second end configured to lock the scaffold, serving as a second fastening means for fastening the scaffold after the pre-embedded reinforcing steel bar is removed from the scaffold; installing outer wall panels each between the adjacent floor slabs laterally, wherein the adjacent outer wall panels are separated by the transverse aluminum extrusion;

wherein when the external walls are completed, the wall connecting rods are disassembled one by one so as to remove the scaffold.

7. The method as claimed in claim 6, wherein the pre-embedded reinforcing steel bar is a corrugated reinforcing bar with an imperial bar size of number 3 (#3), and the corrugated reinforcing steel bar is wound around the scaffold at least three and a half times.

8. The method as claimed in claim 6, wherein after the pre-embedded reinforcing steel bar is removed from the scaffold, part of the pre-embedded reinforcing steel bar, exposed on the corresponding RC slab, is cut off.

9. The method as claimed in claim 6, wherein the locking part is an expansion screw, and the first end of the corresponding wall connecting rod is locked to the expansion screw with a bolt.

10. The method as claimed in claim 6, wherein after the wall connecting rods are disassembled, the locking parts are locked with nuts, or are stuffed with silicone and then scaled with paint.

* * * * *